US008066489B2

(12) United States Patent
Holmes

(10) Patent No.: US 8,066,489 B2
(45) Date of Patent: Nov. 29, 2011

(54) AEROFOIL ASSEMBLY

(75) Inventor: Martin D. Holmes, Bedfordshire (GB)

(73) Assignee: Rolls-Royce PLC, London (GB)

( * ) Notice: Subject to any disclaimer, the term of this patent is extended or adjusted under 35 U.S.C. 154(b) by 940 days.

(21) Appl. No.: 12/010,064

(22) Filed: Jan. 18, 2008

(65) Prior Publication Data

US 2008/0206054 A1 Aug. 28, 2008

(30) Foreign Application Priority Data

Feb. 21, 2007 (GB) ..... 0703426.7

(51) Int. Cl.
*F01D 5/32* (2006.01)

(52) U.S. Cl. ..... 416/193 A; 416/219 R; 416/500; 29/889.21

(58) Field of Classification Search ..... 416/193 A, 416/219 R, 220 R, 248, 500; 29/889.21
See application file for complete search history.

(56) References Cited

U.S. PATENT DOCUMENTS 4,566,857 A * 1/1986 Brumen ..... 416/220 R
5,256,035 A * 10/1993 Norris et al. ..... 416/220 R
5,261,790 A 11/1993 Dietz et al.
5,924,699 A * 7/1999 Airey et al. ..... 277/411
6,659,725 B2 * 12/2003 Yeo et al. ..... 416/190
7,322,797 B2 * 1/2008 Lee et al. ..... 416/193 A

FOREIGN PATENT DOCUMENTS

EP 1 291 492 A1 3/2003
EP 1 635 037 A2 3/2006

* cited by examiner

*Primary Examiner* — Edward Look
*Assistant Examiner* — Andrew C Knopp
(74) *Attorney, Agent, or Firm* — Oliff & Berridge, PLC

(57) ABSTRACT

An aerofoil assembly includes a plurality of rotatable blades. A damping member is disposed between at least two of the blades, each of the at least two blades having an aerofoil portion, a stem portion and a root portion. A recess is provided on two cooperating stem portions with a first shelf extending from a first end of each recess, and a second shelf extending from a second end of each recess to define a compartment. When the blades are aligned the damping member is held on one side of the shelves within the compartment. The damping member is provided with a projection at one corner and a projection on a diagonally opposite corner, the longitudinal distance between ends of the projections being greater than the distance between edges of the first and second shelf.

7 Claims, 2 Drawing Sheets

AEROFOIL ASSEMBLY

BACKGROUND

The invention relates to an aerofoil assembly and a method of assembly of an aerofoil assembly.

Aerofoil assemblies such as stages of a gas turbine compressor or turbine typically have an array of blades 10 which are located in a supporting disc or drum 12 and have a damping member 14 disposed between the blades 10 in order to achieve a desirable vibration characteristic. Such an arrangement is shown in FIGS. 1 to 3 (PRIOR ART) in which the damping member 14 is located in a compartment 16 formed between adjacent blades 10.

The damping member 14, as viewed in FIG. 1, has a "cottage roof" type cross section in that it is part triangular (or "peaked"). As shown in FIGS. 2 and 3 (PRIOR ART), which are sectional views on arrow "A" in FIG. 1 (PRIOR ART) the damping member 14 is largely rectangular in cross section. As also shown in FIG. 2 (PRIOR ART) the compartment 16 is formed by the provision of a recess 18 in each blade 14, and a shelf 20 at either end of the recess 18 forms a support structure 22 for the damping member 14. The member 14 is trapped in the compartment 16 by the shelves 20 since the overall span or longitudinal length "x" of the damping member 14 is greater than the distance between edges 24 of the shelves 20. As shown in FIG. 3 (PRIOR ART) part of the method of assembly requires at least one of the blades 10 to be slid out of the array to allow for a locking member 26 to be inserted in a groove 28, on the rear or forward edge of the blade, in direction B. Thus the damping member 14 must be small enough to allow the blades 10 to move relative to one another to allow access to the groove 28, and yet the damping member 14 must be long enough to stay trapped between the blades 10 when the blades 10 are realigned. Manufacturing tolerances may result in the damping member 14 or support structure 22 being undersize and hence the damping member 14 may fall out. In this eventuality damage may be caused to the blade disc 12 and other components it comes into contact with.

SUMMARY

Hence an assembly in which the damping member is securely trapped, and yet allows relative movement between the blades during assembly, is highly desirable.

According to a first aspect of the present invention there is provided an aerofoil assembly including a plurality of rotatable blades and a damping member disposed between at least two of the blades, each of the at least two blades having an aerofoil portion, a stem portion and a root portion, a recess being provided on two cooperating stem portions with a first shelf extending from a first end of each recess, and a second shelf extending from a second end of each recess to define a compartment, wherein the damping member is provided with a projection at one corner and a projection on a diagonally opposite corner, the longitudinal distance between ends of the projections being greater than the distance between edges of the first and second shelf, such that when the blades are aligned the damping member is held on one side of the shelves within the compartment.

This is advantageous as the projections of the damping member allow relative axial movement of the blades during assembly, but prevent the damping member from becoming dislodged from the compartment during assembly and/or operation of the assembly. Also the provision of projections on the damping members means that no modification to any feature of the known rotor blades is required in order to achieve the advantage. This is of benefit as the damping members are much simpler structures than the rotor blades and carry less load. Hence alterations to the design of the damping members impinge less on the integrity of the aerofoil assembly than would alterations to the rotor blades.

Preferably at least one groove is provided along a leading and/or trailing edge of the stem portion of at least two of the blades and a locking member is located in said groove(s), thereby tying said at least two blades together.

According to a second aspect of the present invention there is provided a method of assembly of an aerofoil assembly including:

a) assembling the plurality of rotor blades adjacent to one another into a circular array such that the blades are in alignment with one another, with a damping member disposed within the compartment of at least one pair of blades;

b) axially displacing one rotor blade relative to the other aligned blades to allow access to the groove, thereby disengaging the damping member projections from the shelves and engaging the other corners of the damping member with the shelves;

c) inserting a locking member in a first direction into the groove(s) of at least one of the aligned blades thereby tying at least two of the blades together;

d) bringing the one rotor blade back into alignment with the other rotor blades thereby engaging the projections with the shelves and disengaging the other corners of the damping member from the shelves, thereby trapping the damping member on one side of the shelves within the compartment.

Preferably the method includes translating the locking member in a second direction such that it is inserted into the groove of the one rotor blade.

The method of assembly using the damping member of the present invention is advantageous as there is a risk with the method of assembly of the prior art that, because of the need to allow relative axial movement of the blades during assembly, the damping member and/or shelves may be undersized. Such under sizing may result in the damping member of the prior art becoming dislodged from the compartment during assembly and/or operation, resulting in damage to engine components.

However, the projections of the damping member of the present invention ensure that the damping member has a longitudinal dimension, which is longer than the largest expected distance between the edges of the shelves. Thus a method of assembly according to the present invention will prevent the damping member from becoming dislodged from the compartment.

BRIEF DESCRIPTION OF THE DRAWINGS

The invention will now be described, by way of example only, with reference to the accompanying drawings, in which.

DETAILED DESCRIPTION OF EMBODIMENTS

Figure 4:
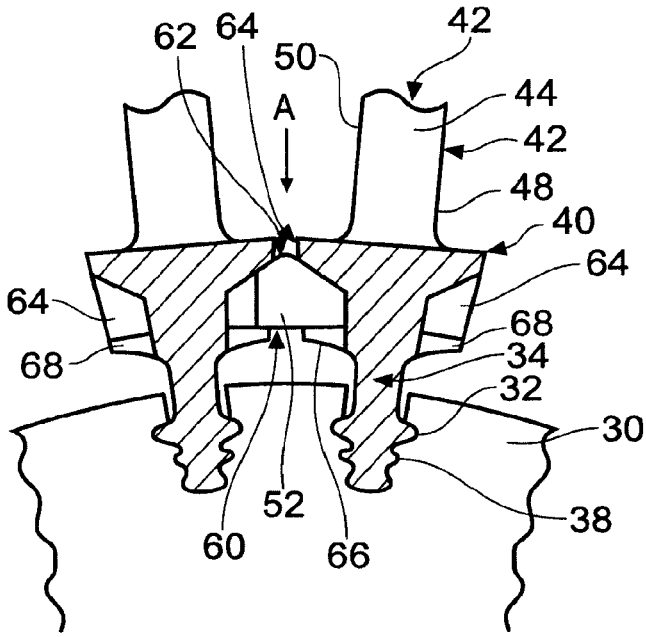
FIG. 4 shows a sectional end on view of part of an aerofoil assembly according to the present invention.

FIG. 4 shows a sectional end on view of part of an aerofoil assembly according to the present invention. A disc 30 is provided with retaining slots (mounting features) 32 into which blades 34 are slid and located. Each blade 34 has a root portion 38, a stem portion 40 an aerofoil portion 42, which is defined by a leading edge 44, a trailing edge 46, a pressure surface 48 and a suction surface 50. For the sake of convenience, the terms "leading edge", "trailing edge", "pressure surface" and "suction surface" will relate to all features of the root 38 and stem 40 portions, which share the same edge or side with the aerofoil surface. A damping member 52, is disposed between each of the blades 34 in a compartment or well 60 that is defined by cavities or recesses 62,64 provided on adjacent pressure/suction surfaces 48,50 of stems 40 of the blades 34. As is more clearly shown in FIGS. 5 and 6, the cavities 62,64 provide a support structure 66 for the damping member 52, the support structure taking the form of a shelf 68 which extends from the trailing and leading edge of the recesses 64.

Figure 1:
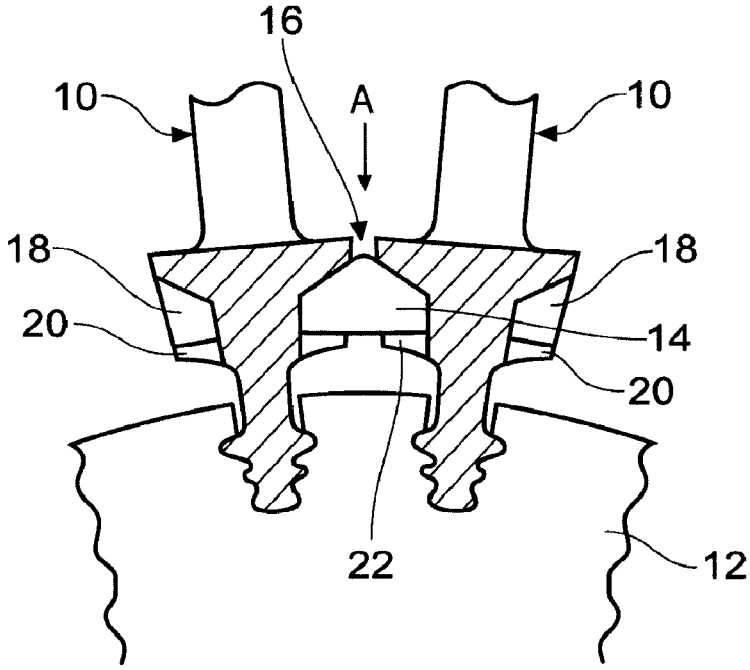
FIG. 1 (PRIOR ART)
FIG. 1 (PRIOR ART) shows a sectional end on view of part of a known aerofoil assembly.
Figure 2:
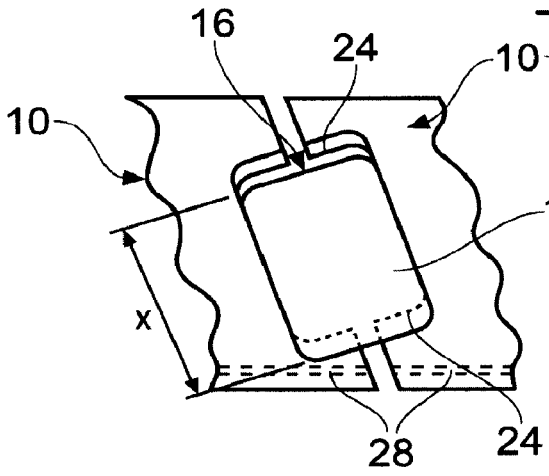
FIG. 2 (PRIOR ART)
FIG. 2 (PRIOR ART) shows a sectional view of part of the assembly as viewed from direction of Arrow A in FIG. 1.
Figure 3:
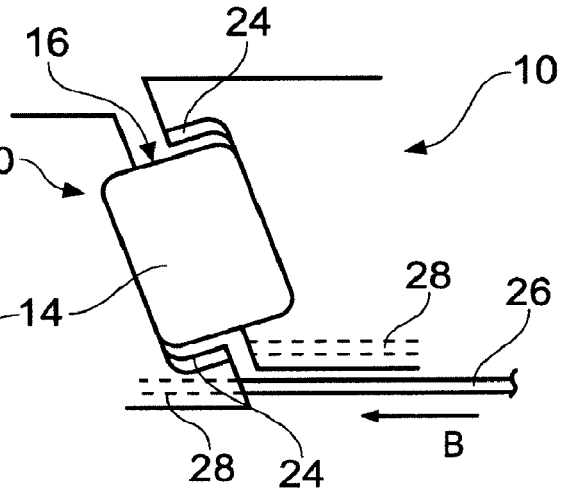
FIG. 3 (PRIOR ART)
FIG. 3 (PRIOR ART) shows the same view as in FIG. 2 but with platforms of the assembly misaligned.
Figure 5:
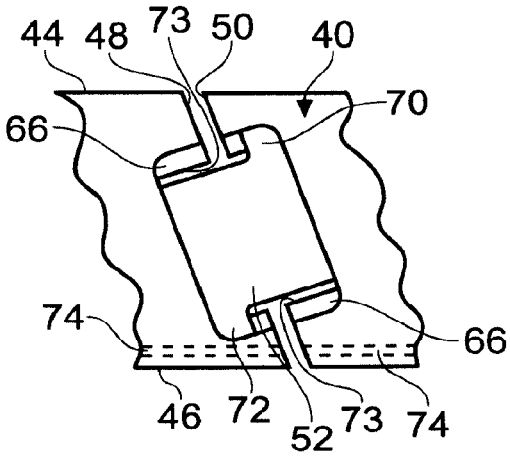
FIG. 5 shows a sectional view of part of the assembly as viewed from direction of Arrow A in FIG. 4.

As with the prior art of FIGS. 1, 2 and 3, the damping member 52, as viewed in FIG. 4, has a "cottage roof" type cross section in that it is part triangular (or "peaked"). Viewed in direction A (and as more clearly shown in FIGS. 5 and 6) the damping member 52 is largely rectangular in cross section. A first projection or lug 70 is provided on one of the corners of the member 52 and second projection or lug 72 is provided on a diagonally opposite corner, giving the damping member 52 a "stepped" profile. Each projection 70,72 is less than half as wide as the main body of the damping member 52. Additionally the "lugs", "steps" or "projections" extend away from the plane edge of the damping member such that the span or overall longitudinal length "y" of the damping member 52 is greater than the distance between the leading and trailing edges 73 of the shelf 68. That is to say, the lugs 70,72 extend beyond the length of the main body of the damping member 52 such that the damping member 52 is longer than the largest distance between edges 73 of the shelves 68 of the support structure 66 when the platforms 40 are assembled and aligned as shown in FIGS. 4 and 5.

Each of the blades 34 and each of the damping members 52 are substantially of the same design. In alternative embodiments the stepped damping member 52 is present between less than all of the compartments 60 formed between the blades 34.

A groove 74 is provided in the trailing edge 46 of each of the stem portions 40. The groove extends circumferentially such that, when the array of blades 34 is assembled and aligned, a continuous groove 74 is formed around the array, which is defined by radially extending parallel walls and an opening which is radially inwards of a closed end. Once assembled a locking member 76 is inserted in the groove 74 of adjacent stems 40, thereby tying at least two blades 34 together. The locking member 76 is a flat strip, which has dimensions that correspond with those of the groove 74 such that the member 76 can be slid easily along the groove 74 during assembly but will interfere sufficiently with the groove 74 such that the member 76 maintains its desired circumferential and radial location relative to the groove 74. In one embodiment the strip has sufficient length to tie only two blades 34 together. In alternative embodiments the strip has sufficient length to tie more than two but less than all of blades 34 together. In a further alternative embodiment the strip has sufficient length to tie all of the blades 34 together. The strip may be arcuate and radially outwardly resilient such that it maintains its position in the groove 74.

Figure 6:
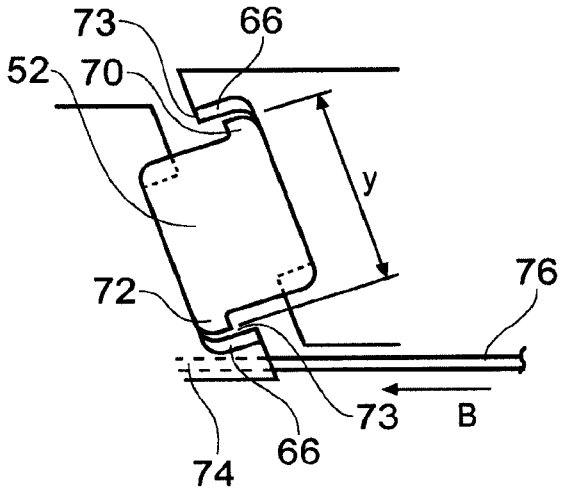
FIG. 6 shows the same view as in FIG. 5 but with platforms of the assembly misaligned.

Such an assembly is assembled by the following method. A set of rotor blades 34 are assembled adjacent one another to form a complete array prior to assembly on the disc 30, with a damping member 52 present between at least two adjacent blades 34, the projections 70,72 resting on the support structure 66. The blades 34 are slid as a complete array onto the disc 30 such that the trailing and leading edges of the blades 34 are in alignment with one another. The blades 34 cannot be slid onto the disc 30 one at a time since the shroud (not shown) of the blade 34 has a different stagger angle to that of the retaining slots 32. One of the blades 34 which part-houses the damping member 52, is axially displaced relative to the others to allow access to the groove 74 as shown in FIG. 6. Sliding the blade 34 in this way disengages the projections 70,72 of the damping member 52 from the shelves 68 and engages the other corners of the damping member 52 (those without lugs/projections) with the support structure 66. A locking member 76 is then inserted in the groove 74 in a first direction B along the length of the groove 74 (as shown in FIG. 6), thereby tying at least two adjacent blades together.

If required, further locking members 76 are inserted into groove 74 to tie the remaining blades 34 together. If more than one locking strip is inserted into groove 74, each locking member 76 is pushed along the groove 74 by the insertion of a further locking member 76. When the locking strip(s) 76 is/are fully inserted, the misaligned rotor blade 34 is brought back into alignment (as shown in FIG. 5). Thus the projections 70,72 are engaged with the shelves 68 and the other corners of the damping member 52 (those without lugs/projections) are disengaged with the shelves 68. In one embodiment a locking member 76, which is already inserted into the groove 74 of the adjacent blade 34 is then slid into the groove 74 of the platform 40 of the previously misaligned blade 34, thereby tying these two blades 34 together. In an alternative embodiment several blades 34 of the array are misaligned in order to insert locking members 76 at different positions around the array. In a further alternative embodiment a specially shaped separate locking member (not shown) is inserted in the groove 74 of the previously misaligned blade 34 and the adjacent blade 34 in order to tie them together.

Once assembled the stepped damper 52 cannot fall out of its retaining compartment 50 because the longitudinal length "y" of the damper 52 is greater than the distance largest between the edges 73 of the shelves 68.

The invention claimed is:

1. An aerofoil assembly comprising:

a plurality of rotatable blades; and a damping member disposed between at least two of the blades, each of the at least two blades having an aerofoil portion, a stem portion and a root portion, a recess being defined by two cooperating stem portions, a first shelf extending from a leading edge of each recess, and a second shelf extending from a trailing edge of each recess to define a compartment, the damping member having a first projection disposed at one corner of the damping member adjacent the first shelf in use, and a second projection on a diagonally opposite corner adjacent the second shelf in use, a longitudinal distance between ends of the first and second projections being greater than a distance between edges of the first and second shelf, such that when the blades are aligned, only one side of the shelves holds the damping member within the compartment.

2. The aerofoil assembly of claim 1, wherein at least one groove is provided along the leading and/or trailing edge of the stem portion of the at least two of the blades and a locking member is located in said groove(s), thereby tying said at least two blades together.

3. The aerofoil assembly of claim 1, wherein each projection is less than half as wide as the damping member.

4. The aerofoil assembly of claim 1, wherein each of the blades and each of the damping members are substantially of the same design.

5. The aerofoil assembly of claim 1, wherein one of the plurality of rotatable blades is configured to engage the projections and to disengage the other corners of the damping member when the one of the plurality of rotatable blades is brought into alignment with the other rotatable blades, and the damping member is trapped on only one side of the shelves within the compartment.

6. A method of assembling the aerofoil assembly of claim 2, comprising:

a) assembling the plurality of rotatable blades adjacent to one another into a circular array such that the blades are in alignment with one another, with the damping member disposed within the compartment of the at least two of the blades;

b) axially displacing one rotatable blade relative to the other aligned blades to allow access to the groove, thereby disengaging the damping member projections from the shelves and engaging the other corners of the damping member with the shelves;

c) inserting a locking member in a first direction into the groove(s) of at least two of the aligned blades thereby tying at least two of the blades together;

d) bringing the one rotatable blade back into alignment with the other rotatable blades thereby engaging the projections with the shelves and disengaging the other corners of the damping member from the shelves, thereby trapping the damping member on one side of the shelves within the compartment.

7. The method of claim 6, further comprising translating the locking member in a second direction such that it is inserted into the groove of the one rotatable blade.

* * * * *